US011352760B2

(12) United States Patent
Stell

(10) Patent No.: US 11,352,760 B2
(45) Date of Patent: Jun. 7, 2022

(54) MASONRY BLOCK

(71) Applicant: Shoreline Stone Manufacturing Carib, Inc., Largo, FL (US)

(72) Inventor: Jason Stell, Largo, FL (US)

(73) Assignee: Shoreloc Design Group, Inc., Largo, FL (US)

( * ) Notice: Subject to any disclaimer, the term of this patent is extended or adjusted under 35 U.S.C. 154(b) by 0 days.

(21) Appl. No.: 17/066,656

(22) Filed: Oct. 9, 2020

(65) Prior Publication Data

US 2022/0112677 A1 Apr. 14, 2022

(51) Int. Cl.
*E02D 29/02* (2006.01)

(52) U.S. Cl.
CPC ..... *E02D 29/0266* (2013.01); *E02D 29/025* (2013.01); *E02D 2300/002* (2013.01); *E02D 2300/0084* (2013.01)

(58) Field of Classification Search
CPC ..... E02D 29/0266; E02D 29/025; E02D 2300/002; E04B 2002/0265; E04B 2002/0263; E04B 2/12; E04B 2/32; E04B 2/46
See application file for complete search history.

(56) References Cited

U.S. PATENT DOCUMENTS 4,619,560 A 10/1986 Crinnion
5,484,236 A 1/1996 Gravier
5,816,749 A 10/1998 Bailey, II
5,951,210 A * 9/1999 Maguire ..... E02D 29/025 405/286
6,416,260 B1 * 7/2002 Khamis ..... E02D 29/0241 405/262
6,543,969 B1 4/2003 Adam
6,854,220 B2 2/2005 Dueck et al.
6,978,580 B1 12/2005 Clark et al.
7,037,047 B1 5/2006 Tufts et al.
(Continued)

FOREIGN PATENT DOCUMENTS

KR 300513040.0000 12/2008
KR 2018094268 * 8/2018 ..... E02D 17/2015
(Continued)

OTHER PUBLICATIONS

Retaining Wall, Wikipedia, https://en.wikipedia.org/wiki/Retaining_wall, last accessed Sep. 21, 2019.

*Primary Examiner* — Carib A Oquendo
(74) *Attorney, Agent, or Firm* — Larson & Larson, P.A.; Frank Liebenow; Justin P. Miller

(57) ABSTRACT

A masonry block has a front, a back, a top surface, a bottom surface, a first side and a second side. The front has a front-top edge and a front-bottom edge. A number of steps (e.g. two steps) that rise above the top surface are setback from the front-top edge by a first setback distance. An equal number of notches are formed/cut into the bottom surface. A first notch of the notches is setback from the front-bottom edge by a second setback distance. When stacked to form a wall, the steps of a lower masonry block interface with the notches of a next higher masonry block and the first setback distance is greater than the second setback distance resulting in an overall setback as defined by a difference between the first setback distance minus the second setback distance.

20 Claims, 16 Drawing Sheets

(56) References Cited

U.S. PATENT DOCUMENTS

| | | | | |
|---|---|---|---|---|
| 7,096,634 | B2 | 8/2006 | Dean, Jr. | |
| 7,168,892 | B1 * | 1/2007 | MacDonald | E02D 29/0225 405/284 |
| 7,244,079 | B1 | 7/2007 | Blomquist et al. | |
| 7,384,215 | B2 | 6/2008 | Woolford | |
| D587,382 | S | 2/2009 | Wauhop | |
| 7,712,281 | B2 | 5/2010 | Bott | |
| 7,963,727 | B1 * | 6/2011 | Wauhop | E02D 29/025 405/286 |
| D645,575 | S | 9/2011 | Bone | |
| D663,858 | S | 7/2012 | MacDonald | |
| D671,657 | S | 11/2012 | MacDonald | |
| D685,502 | S | 7/2013 | MacDonald | |
| D708,765 | S | 7/2014 | MacDonald | |
| D711,014 | S | 8/2014 | MacDonald | |
| 9,701,046 | B2 | 7/2017 | Karau | |
| D846,760 | S | 4/2019 | Lundell et al. | |
| D866,004 | S | 11/2019 | Johnson | |
| 10,583,588 | B2 | 3/2020 | Karau | |
| D900,342 | S | 10/2020 | Rainey | |
| D919,838 | S | 5/2021 | Kloss et al. | |
| 2002/0023403 | A1 | 2/2002 | Whitson | |
| 2002/0083657 | A1 | 7/2002 | Mattox et al. | |
| 2007/0175161 | A1 * | 8/2007 | Sunseth | E04C 1/395 52/604 |
| 2008/0277561 | A1 | 11/2008 | MacDonald | |
| 2011/0217127 | A1 | 9/2011 | MacDonald | |
| 2014/0037389 | A1 | 2/2014 | Welling | |

FOREIGN PATENT DOCUMENTS

| | | |
|---|---|---|
| KR | 101961430 | 3/2019 |
| KR | 102173364 | 11/2020 |

* cited by examiner

MASONRY BLOCK

FIELD

This invention relates to the field of wall/barrier construction and more particularly to a masonry block for construction of, for example, retaining walls.

BACKGROUND

Masonry blocks of concrete blocks have many uses such as soil retention, retaining walls, and landscaping. There are many masonry blocks in existence today, each with their range of uses and aesthetic properties. One simple example is what is known as a cinder block. A cinder block is a block made of concrete and cinder, making it lighter weight than a block made entirely of concrete. Cinder blocks are generally used in foundations and walls of buildings, typically laid in an alternating pattern and held together with mortar. Such construction provides very good load bearing, but does not provide sufficient sheer strength, for example, for retaining soil as the weight of the soil and water held by the soil presents a high amount of sheer force against a retaining wall.

A retaining wall requires extra sheer strength to prevent the retaining wall from sliding, bowing, or collapsing due to the material that is being retained such as soil, sand, stone, often having various amounts of water due to rain and runoff. Currently, many different materials are used to make retaining walls. The material used depends upon the application and size of the wall. For example, a retaining wall that supports a roadway is often made of a steel wall or a concrete and steel wall while a retaining wall for landscaping is often made of a material with aesthetic values such as railroad ties or solid concrete blocks.

Generally, for many retaining walls of small heights, typically less than six feet high, there is not much pressure from the material being retained (e.g. soil) and not too much engineering required as the weight of the blocks are typically sufficient to prevent shifting from pressure of the material being retained. Many concrete blocks are available for such use in home improvement stores and many home projects are successfully completed, building such retaining walls by those who are not skilled in engineering of larger projects.

As the height of the retaining wall increases, so does the pressure exerted against the concrete blocks used to fabricate the retaining wall. Building walls that are higher than six feet high requires special skill as they must be engineered to resist the sheer force exerted from the soil, rock, and water that is being retained behind the wall. In recent years, a layer of geogrid has been deployed between blocks of such walls. Each layer of geogrid is laid between the blocks and stone is backfilled on top of the geogrid, layer by layer. In this way, the geogrid provides additional resistance to sheer forces from behind the retaining wall.

There are several engineering parameters designed to provide sufficient sheer strength to a retaining wall made of concrete blocks. One parameter is "setback" which is generally considered the distance in which one course of a wall extends beyond the front surface of the next highest course of the wall. This angle of the retaining wall counter acts the pressure of the soil behind the wall. For example, a wall of standard clay bricks having no setback is easy for anybody to push over, but setting each brick back ½ inch from the lower brick makes it difficult to push over from the back.

Other engineering issues for concrete blocks used to make a retaining wall include friction between successive blocks. This friction is enhanced by the weight of successive blocks (those above) making it difficult for the concrete blocks to slide on each other which would result in holes in the retaining wall or total failure/collapse.

In some retaining wall construction, it is desired to limit the setback as, in some applications, there is insufficient space to construct a retaining wall that has the required setback. This may be due to a property line or a roadway configuration not providing ample space to properly setback the retaining wall. In such, the concrete blocks must be able to create a retaining wall that is virtually vertical while resisting the sheer force of the material held behind the retaining wall. In such applications, the retaining wall is further supported through the use of various construction techniques such as pins (e.g. a length of rebar passing vertically through the retaining wall), deadheads, tie-backs, etc. The engineering and construction of such is complicated and relies on the added support construction which, if a failure occurs such as the rebar rusts, the entire retaining wall is compromised.

Another issue with prior concrete block construction is curves, both convex and concave. When using a conventional block system having rectangular blocks to create a concave retaining wall, the rectangular blocks just touch at one point adjacent to the faces of the blocks, reducing friction between adjacent blocks to that point only. Therefore, lateral soil pressure from behind the retaining wall pushes against each individual block and, having only one point of resistance, such a block has little resistance to lateral soil pressure. For a convex retaining wall, the same situation occurs, only the touch point is at the back corners of the blocks, though another issue occurs in that the faces of the blocks are separated by a space that is proportional to a radius of the convex curve, which is often not desired for aesthetic reasons.

As with many types of construction, there are those who can understand and engineer walls made of concrete blocks (engineers) and there are those who construct walls made of concrete blocks (builders). For many projects, the engineering and construction is left to builders when there is often a need for engineering before the wall is constructed. Further, even when properly engineered, some such builders don't understand and/or don't follow the engineered design and the resulting concrete block wall has the potential to fail under certain load conditions. It is preferred that the concrete blocks provide features that make it difficult or impossible to construct a concrete block wall that does not conform to certain engineering constructs such as curvature radius and block-to-block setback.

What is needed is a concrete block system that will provide structural strength while enabling straight or curved wall contours.

SUMMARY

In one embodiment, a masonry block is disclosed including a masonry block body having a front, a back, a top surface, a bottom surface, a first side and a second side. The front has a front-top edge and a front-bottom edge. A number of steps (e.g. two steps) that rise above the top surface are setback from the front-top edge by a first setback distance. An equal number of notches are formed/cut into the bottom surface. A first notch of the notches is setback from the front-bottom edge by a second setback distance. When stacked to form a wall, the steps of a lower masonry block interface with the notches of a next higher masonry block and the first setback distance is greater than the second setback distance resulting in an overall setback as defined by a difference between the first setback distance minus the second setback distance.

In another embodiment, a method of constructing a structure with masonry blocks is disclosed. The resulting structure has a fixed setback. The method includes setting a first layer of the masonry blocks on a footing. The masonry blocks having a front, a back, a top surface, a bottom surface, a first side and a second side, the front having a front-top edge and a front-bottom edge. Next, setting a subsequent layer of the masonry blocks on top of the first layer of the masonry blocks such that notches in the front bottom edge of each masonry block of the subsequent layer mate with steps on the top surface of the first layer of the masonry blocks. The steps are setback from the front-top edge by a first setback distance and a first notch of the notches are setback from the front-bottom edge by a second setback distance and therefore, the fixed setback of the structure is defined by subtracting the first setback distance minus the second setback distance.

In another embodiment, a masonry block is disclosed. The masonry block body has a front, a back, a top surface, a bottom surface, a first side and a second side and the front has a front-top edge and a front-bottom edge. Two steps are formed on the top surface of the masonry block rising above the top surface, a first step of the two steps being setback from the front-top edge by a first setback distance. Two notches are formed/cut into the bottom surface of the masonry block. A first notch of the two notches is setback from the front-bottom edge by a second setback distance. When stacked to form a wall, the two steps of a lower masonry block interface with the two notches of a next higher masonry block, the first setback distance is greater than the second setback distance, and an overall setback of the wall is defined by a difference between the first setback distance minus the second setback distance.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
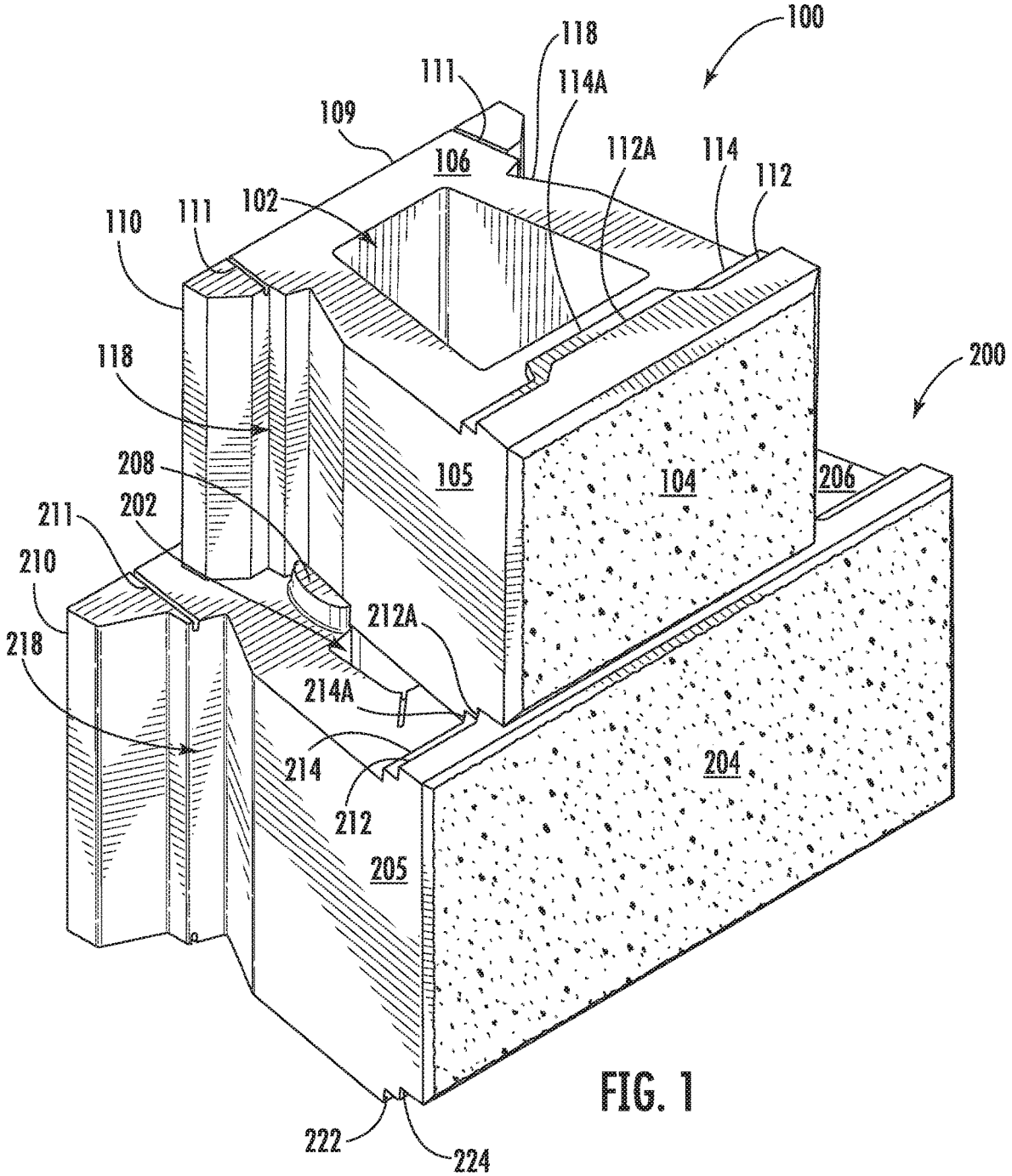
FIG. 1 illustrates a perspective view of a small masonry block positioned atop a large concrete block.

Reference will now be made in detail to the presently preferred embodiments of the invention, examples of which are illustrated in the accompanying drawings. Throughout the following detailed description, the same reference numerals refer to the same elements in all figures.

Throughout this description, several features of the disclosed blocks are referred to using a common terminology. The back side of the masonry blocks include block legs. In some embodiments, there are break points which are score lines in the masonry blocks that permit clean breaks of the masonry blocks along the score lines, typically using a simple tool such as a hammer and chisel. The disclosed masonry blocks have a central opening (hollow) for reducing overall weight. The front top edge of the disclosed masonry blocks has steps that mate with notches along the front bottom edge of the next higher masonry block. The disclosed masonry blocks also have protrusions located on a top surface, typically near the opening, for locking with successive masonry blocks and for improved stacking, as will be described.

Throughout this document, the features of the masonry blocks are described with respect to the outwardly facing surface of the masonry block body being referred to as the front, the surface that is mostly visible from the outside of the wall when the masonry blocks are incorporated into a wall. The bottom is the surface that, when installed in a wall, is at a lowest altitude and touches the next lower masonry block or ground surface/footings. The top is the surface that, when installed, is distal from the next lower masonry block and, if a subsequently higher layer of concrete blocks is included, the top of the masonry block contacts the bottom of masonry blocks of the subsequently higher layer of masonry blocks. The back is the surface that is opposite of the front and typically is in direct contact with the material being retained by the wall, for example, soil, rocks, etc.

Throughout this description, a large masonry block 200 and a small masonry block 100 are described, large and small being relative to the size of each other masonry block 100/200. The described masonry blocks 100/200 are designed to create structurally sound walls using either all small masonry blocks 100, all large masonry blocks 200 or any combination of masonry blocks 100/200. Note that although the primary composition of the masonry blocks 100/200 is concrete, it is fully anticipated that other materials are included in the masonry blocks 100/200 such as strengtheners, fillers, and/or moisture.

The masonry blocks 100/200 are disclosed having steps on a top surface and notches on a bottom surface. Although it is anticipated to include the steps on the bottom surface and the notches on the top surface, it is preferred to have the steps on the top surface and notches on the bottom surface, leaving the bottom surface relatively flat for interfacing with transportation (e.g. palettes, truck floors) and for interfacing with footings.

The described masonry blocks 100/200 are typically formed by filling a mold with a masonry material (e.g. concrete, moisture, filler) and applying pressure to form the masonry blocks 100/200, then allowing the masonry blocks 100/200 to set either in open air or in a temperature/humidity controlled environment.

Figure 2:
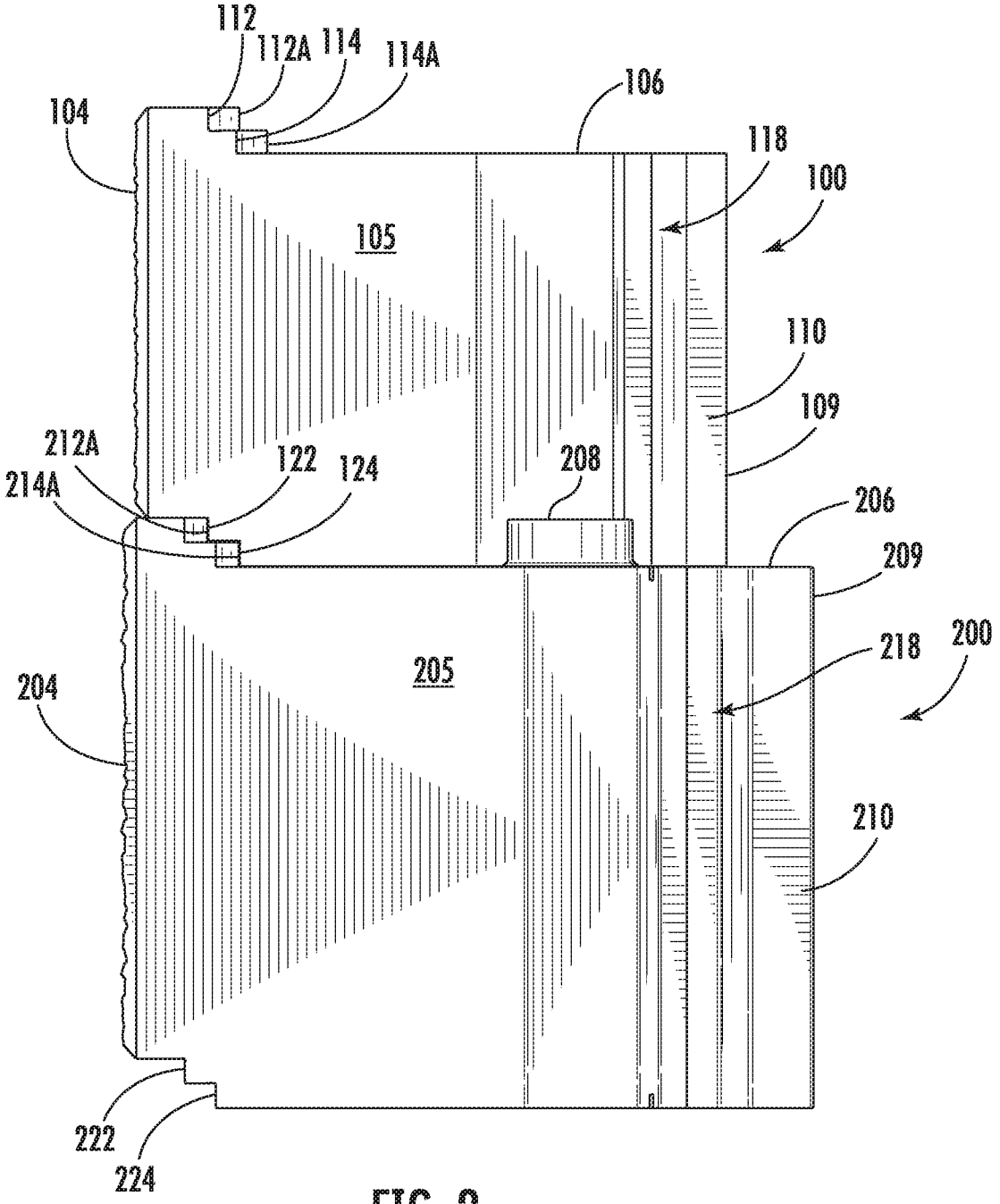
FIG. 2 illustrates a side view of the small masonry block positioned atop a large concrete block.

Referring to FIGS. 1 and 2, views of a small masonry block 100 positioned atop a large masonry block 200 are shown. Although, in FIGS. 1 and 2, it is shown how the small masonry block 100 interfaces with the large masonry block 200, any configurations of small masonry block 100 and large masonry block 200 are anticipated including walls made entirely of either small masonry blocks 100 or walls made entirely of large masonry blocks 200.

The large masonry block 200 has a large masonry block front 204 (the face part that is visible when built into a wall) with large masonry block sides 205 having large masonry block insets 218 and large masonry block legs 210. There is a large masonry block opening 202, the purpose of such is for reducing the total weight of the large masonry block 200.

The small masonry block 100 has a small masonry block front 104 (the face part that is visible when built into a wall) with small masonry block sides 105/107 having small masonry block insets 118 and small masonry block legs 110. There is a small masonry block opening 102, the purpose of such is for reducing the total weight of the small masonry block 100.

The small masonry block top surface 106 has small masonry block steps 112/114/112A/114A. As either of the small masonry block 100 or large masonry block 200 are stacked upon each other, the steps (small masonry block steps 112/114/112A/114A or large masonry block steps 212/214/212A/214A) mate with notches of the masonry block above (small masonry block notches 122/124 or large masonry block notches 222/224). This mating helps make sure that the proper setback is made (note the forced setback shown in FIG. 1) and also provides structural support keeping upper layers of the masonry blocks 100/200 from being pushed out with respect to lower layers of the masonry blocks 100/200.

Also shown in FIG. 1, the large masonry block key 208 of the large masonry block top surface 206 rests against the side of the small masonry block 100. The mating of the large masonry block key 208 with the small masonry block side 105 of the small masonry block 100 helps make sure that proper spacing is maintained as well as limiting lateral movement of successive layers of the masonry blocks 100/200.

Note that the small masonry block steps 112/114/112A/114A include outer small masonry block steps 112/114 and inner small masonry block steps 112A/114A. The purpose of such is to provide maximum step contact with the notches (small masonry block notches 122/124 or large masonry block notches 222/224) of subsequent higher layers of the masonry blocks 100/200 when the masonry blocks 100/200 are arranged in a concave formation. Note that the small masonry block notches 122/124 and large masonry block notches 222/224 are substantially linear.

The small masonry block 100 has a small masonry block top surface 106 and small masonry block legs 110. The large masonry block 200 has a large masonry block top surface 206 and large masonry block legs 210.

The large masonry block legs 210 have score lines 211 for knocking off the large masonry block legs 210 in a predictable way with a simple tool such as a hammer and chisel.

Figure 3:
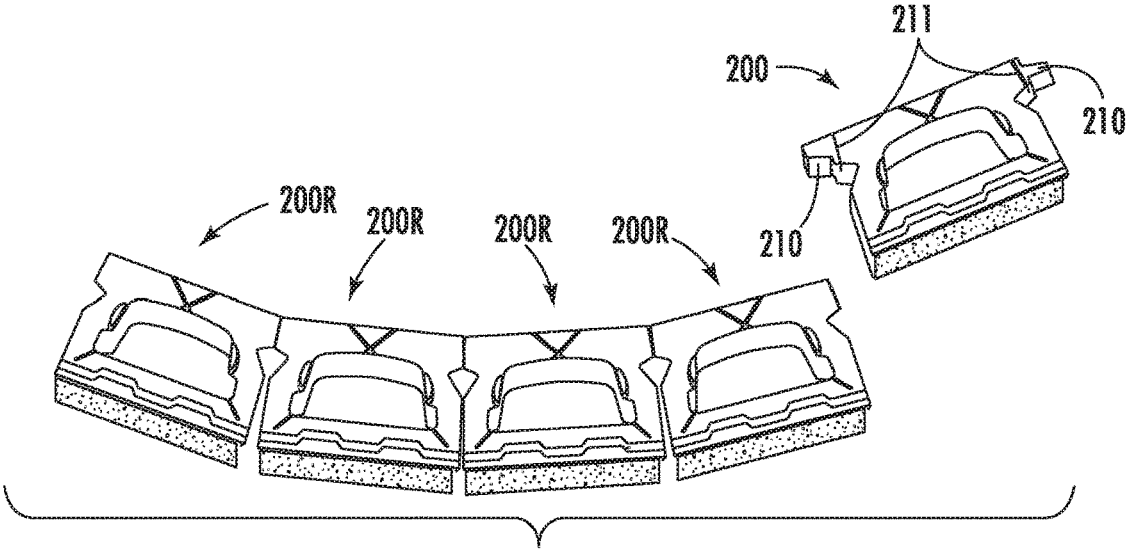
FIG. 3 illustrates a plan view of several of the large masonry blocks arranged in a convex curve in which another large masonry block is to be added.
Figure 4:
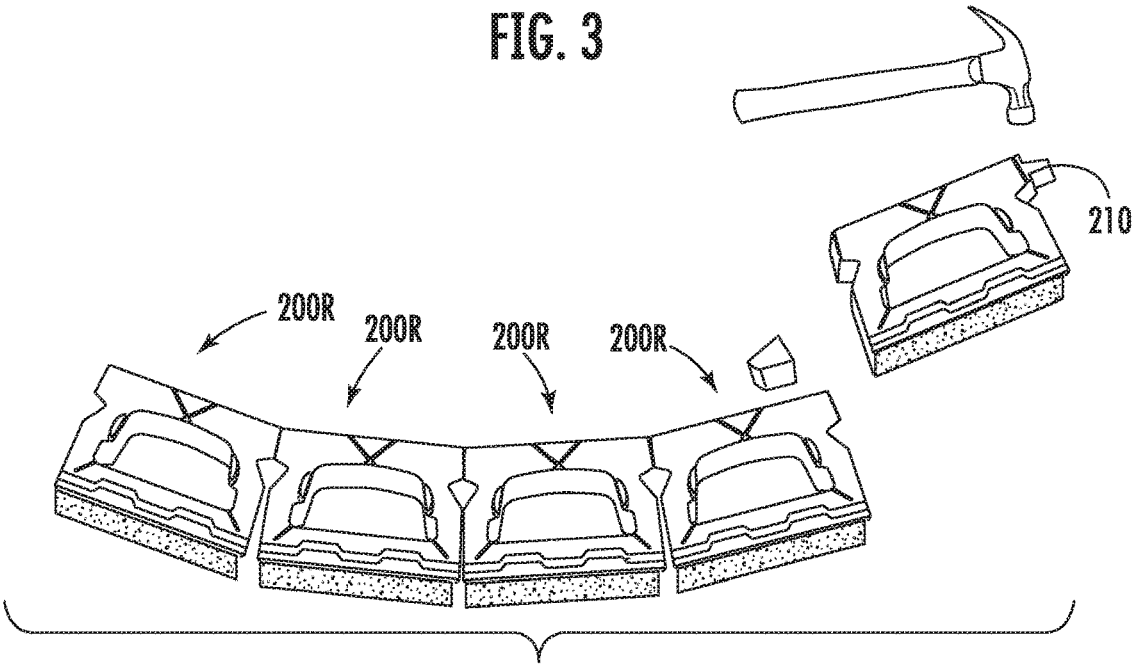
FIG. 4 illustrates a second plan view of several of the large masonry blocks arranged in a convex curve in which another large masonry block is modified by breaking off the legs along the score line.
Figure 5:
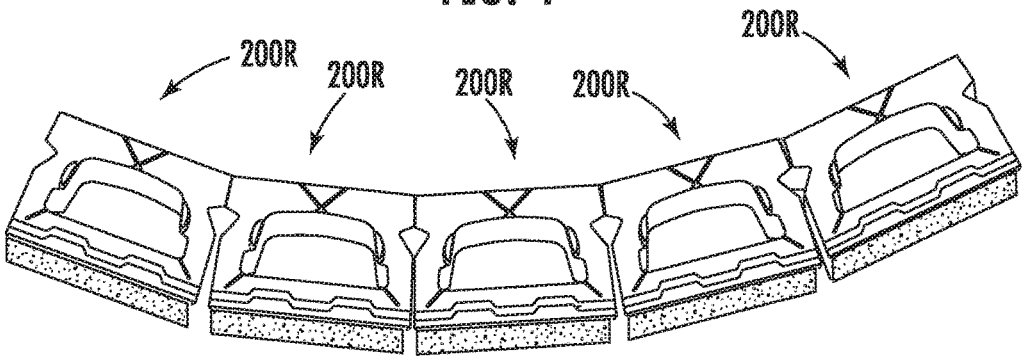
FIG. 5 illustrates a second plan view of several of the large masonry blocks arranged in a convex curve in which another large masonry block is added into the convex curve after being modified by breaking off the legs along the score line.

Referring to FIGS. 3, 4, and 5, plan views of several of the large masonry blocks 200R arranged in a convex curve are shown in which another large masonry block 200 is to be added. It is difficult to form curved walls using masonry blocks of the prior art, often requiring cutting of such blocks to form the curved wall. As shown in FIGS. 3, 4, and 5, by knocking off the large masonry block legs 210 of each large masonry block 200, a wall with a specific radius is formed. Note, walls of different radii are anticipated based upon setting each of the masonry blocks 100/200 with their sides abutting near the front of the masonry blocks 100/200 and setting the distance between the masonry block legs 110/210 (or sides after removal of the masonry block legs 110/210).

Figure 6:
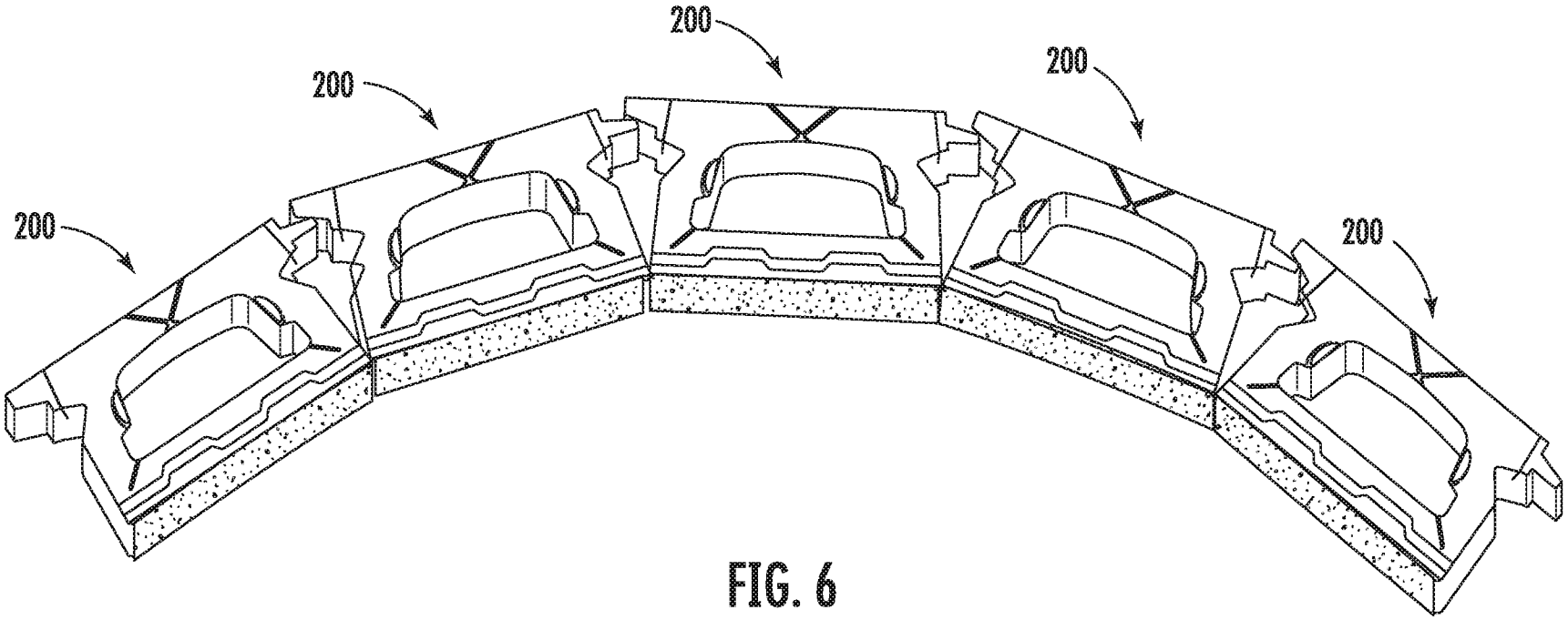
FIG. 6 illustrates a plan view of several of the large masonry blocks arranged in a concave curve.

Referring to FIG. 6, a plan view of several of the large masonry blocks 200 arranged in a concave curve is shown. In this configuration, the large masonry block legs 210 of the large masonry blocks 200 are left intact and only the side edges near the large masonry block front 204 touch and impart friction against each other. Although, in this configuration, there is minimum friction between adjacent large masonry blocks 200, it is difficult for such large masonry blocks 200 to be moved by soil pressure due to the concave arrangement of the large masonry blocks 200 and further by interaction between the large masonry block legs 210.

Figure 7:
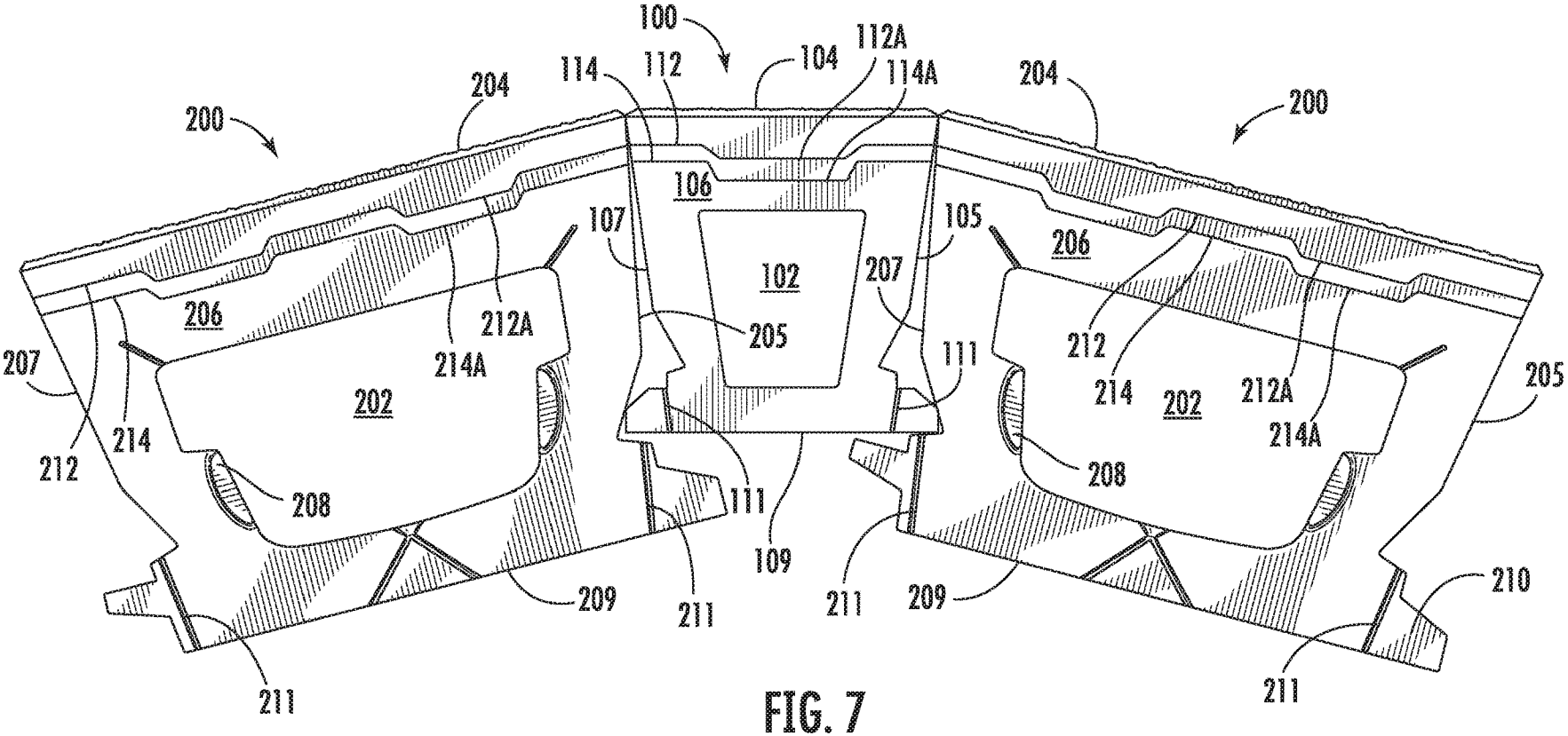
FIG. 7 illustrates a plan view of alternating of the large masonry blocks with small masonry blocks arranged in a convex curve.

Referring to FIG. 7, a plan view of alternating of the large masonry blocks 200 with small masonry blocks 100 arranged in a convex curve is shown. In this view, a smaller radius convex curved wall is formed by alternating of large masonry blocks 200 with small masonry blocks 100. Note how the small masonry block legs 110 rest within the large masonry block inset 218. This aligns the small masonry block 100 with the adjacent large masonry blocks 200 and prevents the small masonry block 100 from being pushed out from between the adjacent large masonry blocks 200 by pressure from materials behind this convex wall.

Figure 8:
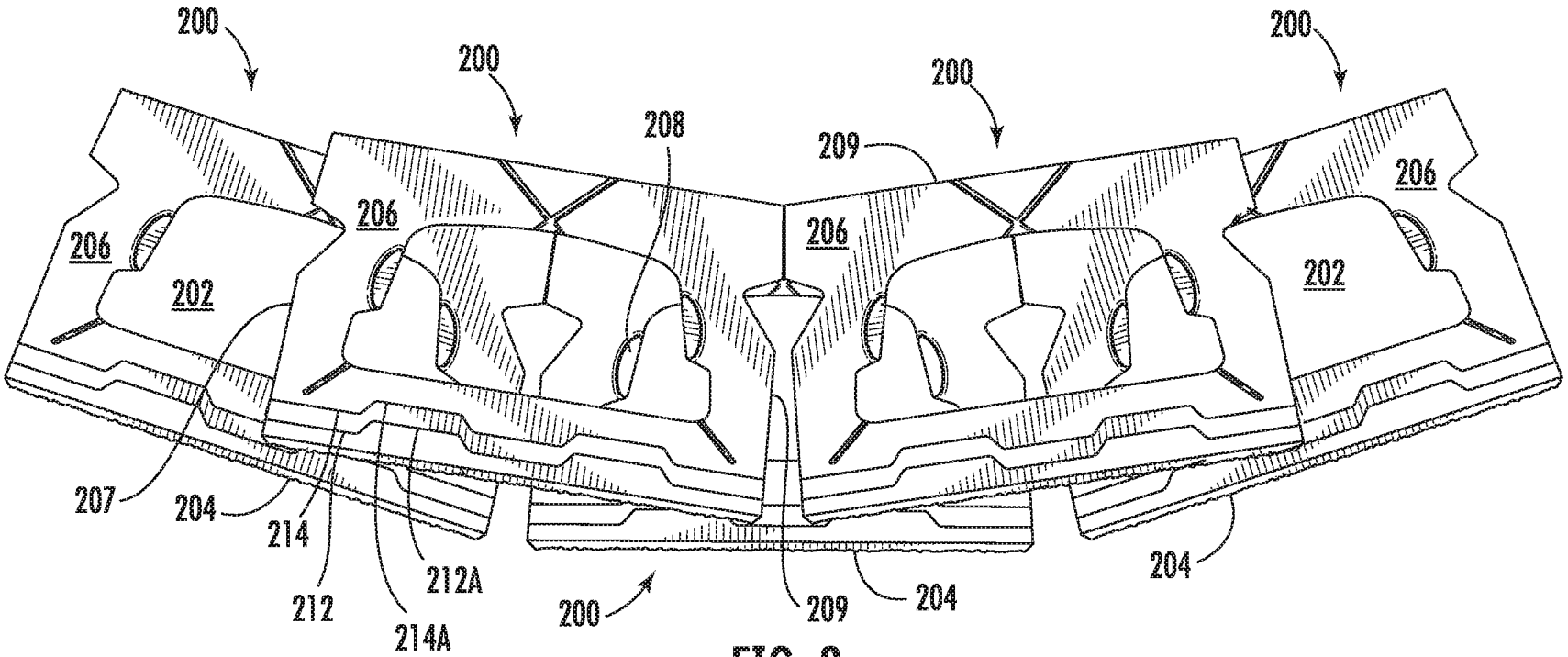
FIG. 8 illustrates a plan view of overlapping layers of large masonry blocks arranged in a convex curve.

Referring to FIG. 8, a plan view of overlapping layers of large masonry blocks 200 arranged in a convex curve is shown. Note, in this example, the large masonry block legs 210 remain intact and touch while the side edges of the large masonry block 200 near the large masonry block front 204 are set slightly apart.

This pattern of large masonry blocks 200 takes advantage of staggering of the large masonry block steps 212/214/212A/214A. When there are multiple layers of masonry blocks 100/200 set at an angle to each other, the large masonry block notches 222/224 of the large masonry blocks 200 of an upper layer of the large masonry blocks 200 interface both with the outer large masonry block steps 212/214 and inner large masonry block steps 212A/214A. This provides improved structural strength as well as guides for setting each layer at a similar angle with respect to the next lower layer of the large masonry blocks 200. Note the same principle is present in the small masonry blocks 100 having outer small masonry block steps 112/114 and inner small masonry block steps 112A/114A (see FIG. 1).

It is anticipated that during construction, as for example in the landscape structure or wall such shown in FIG. 8, the structure or wall is generally constructed one layer at a time. Each layer of the masonry blocks 100/200 are set on top of subsequent lower layers of masonry blocks 100/200 such that the masonry block steps 112/114/112A/114A/212/214/212A/214A of the lower (prior) layer of masonry blocks 100/200 interface with the masonry block notches 122/124/222/224 of the layer of masonry blocks 100/200 that are being set. This provides a positive connection between layers. Since the masonry block steps 112/114/112A/114A/212/214/212A/214A of the prior layer of masonry blocks 100/200 are elevated with respect to the masonry block top surface 106/206, the layer of masonry blocks 100/200 that are being set are unable to be pushed forward beyond where the masonry block notches 122/124/222/224 touch/interface with the masonry block steps 112/114/112A/114A/212/214/212A/214A, forcing setting of this layer of masonry blocks 100/200 at the correct setback and preventing each subsequent layer of masonry blocks 100/200 from being pushed forward by sheer forces coming from the material being retained by the wall/structure.

In such, the masonry block steps 112/114/112A/114A/212/214/212A/214A are setback from a front top edge of the masonry blocks 100/200 by a first setback distance and the masonry block notches 122/124/222/224 are setback from a front bottom edge by a second setback distance that is less than the first setback distance. In this way, the overall setback of a construction (e.g. wall) made of such masonry blocks 100/200 is defined by the difference between the first setback distance and the second setback distance. For example, if the first setback distance is two-inches and the second setback distance is five-inches, the each subsequently higher layer of the masonry blocks 100/200 will be setback three-inches from the base layer of the masonry blocks 100/200 (assuming proper installation in which the masonry block steps 112/114/112A/114A/212/214/212A/214A interface/abut the masonry block notches 122/124/222/224).

The number of masonry block steps 112/114/112A/114A/212/214/212A/214A is shown as two as is the number of the masonry block notches 122/124/222/224, though any number of steps and notches is anticipated, including one step and one notch. It is preferred that the number of steps equals the number of notches, though not required.

In some embodiments, after each layer of masonry blocks 100/200 are set, the appropriate fill is placed behind the wall as well as the appropriate fill used to fill the masonry block openings 102/202 such as rock, stone, gravel, and/or concrete. Once complete, pressure on the structure or wall from behind the wall (material that is to be retained by the wall) tend to force the masonry blocks 100/200 of each subsequently higher layer outward towards the front of the wall. The interface between the masonry block steps 112/114/112A/114A/212/214/212A/214A and the masonry block notches 122/124/222/224, along with friction between touching surfaces of the masonry blocks 100/200 resist the movement between the masonry blocks 100/200. It is fully intended that the structure/wall be formed using masonry blocks 100/200 without the use of mortar, though the use of mortar is not precluded. It is also anticipated that after setting each layer of the masonry blocks 100/200, a layer of geogrid is placed over the layer of masonry blocks 100/200, extending behind the masonry blocks 100/200 to be covered with fill as the fill is placed behind the wall/structure after each layer of the masonry blocks 100/200 are set.

Figure 9:
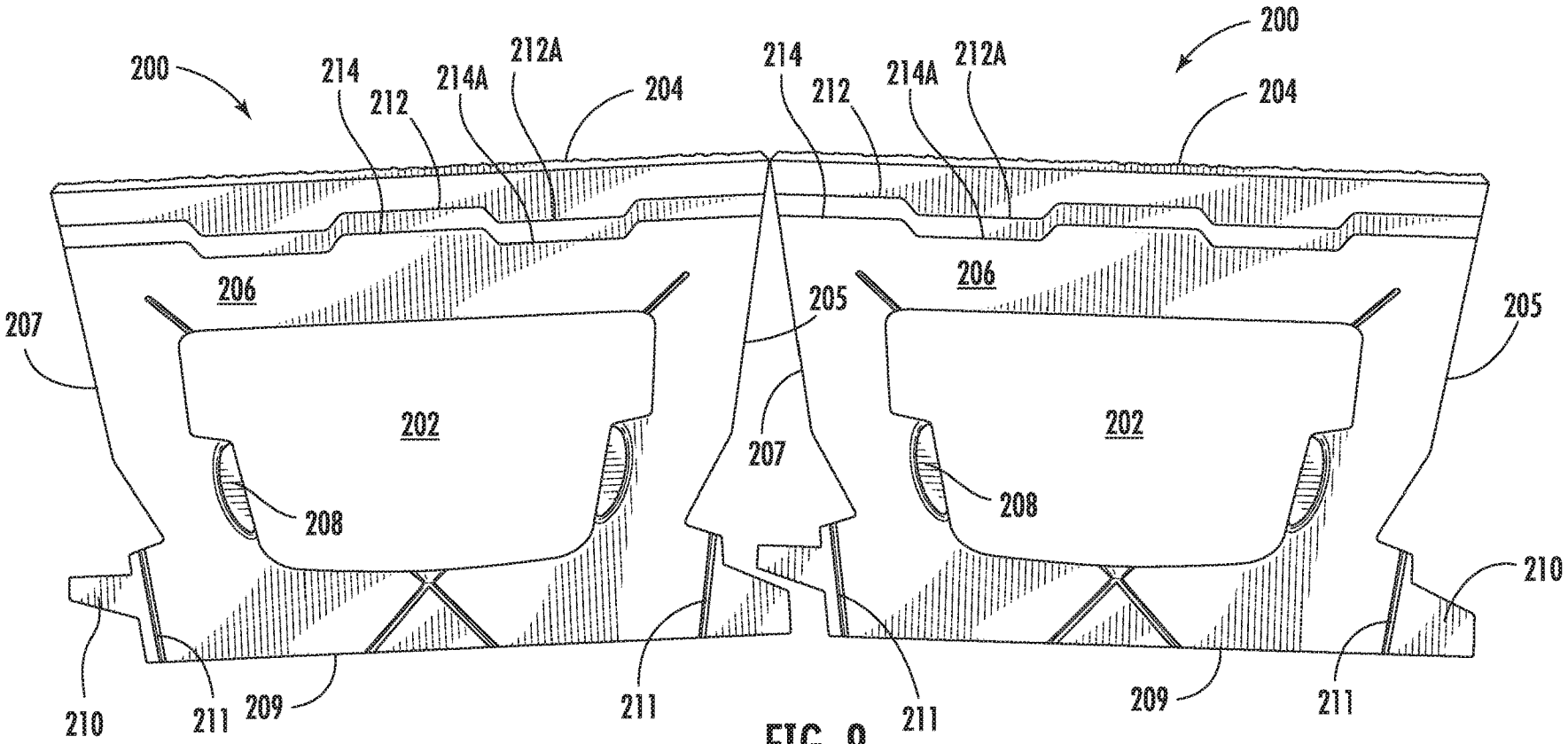
FIG. 9 illustrates a plan view of large masonry blocks arranged in a convex curve.
Figure 10:
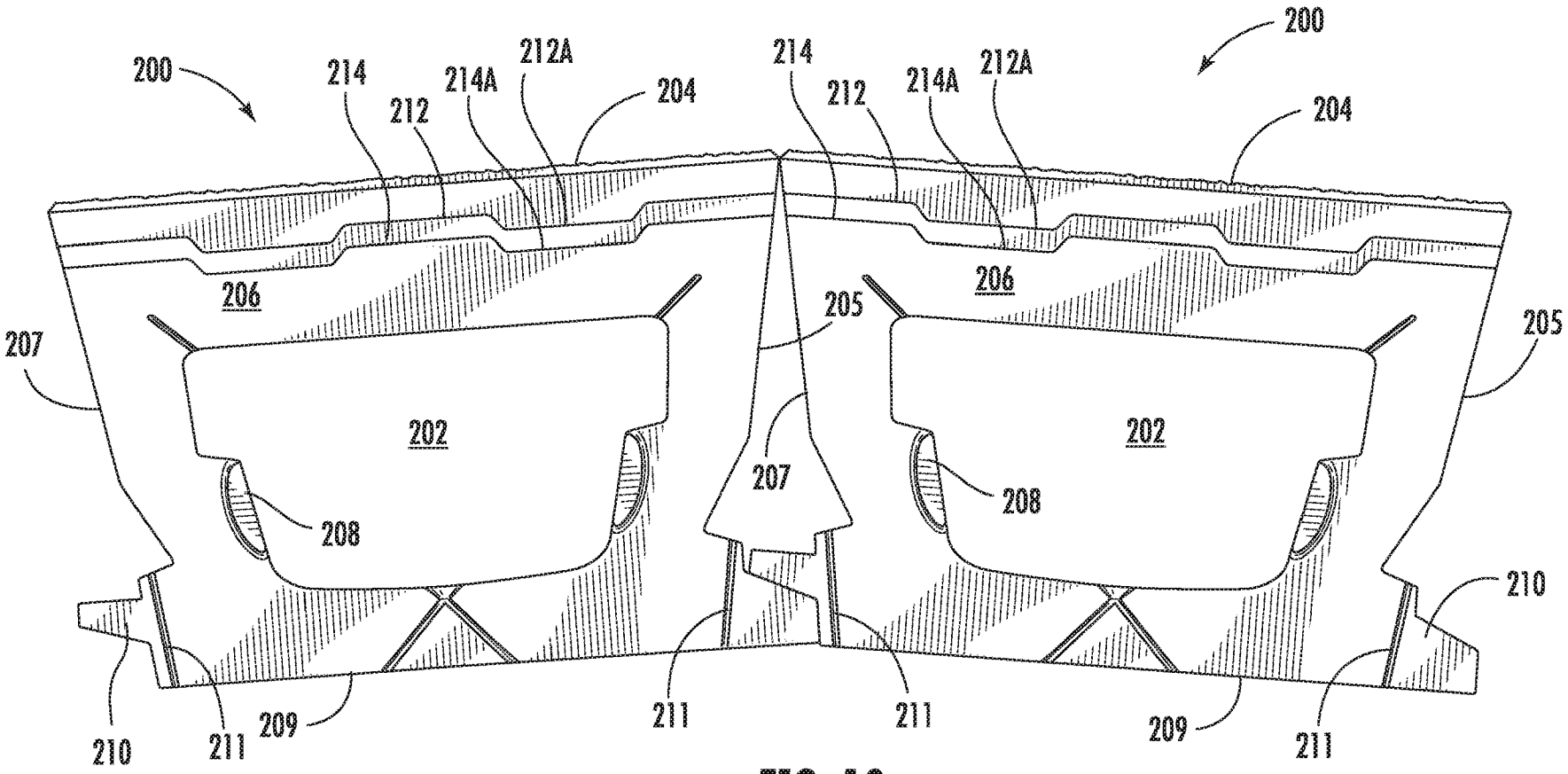
FIG. 10 illustrates a closeup plan view of the interface between the large masonry blocks arranged in a convex curve.

Referring to FIGS. 9 and 10, plan views of large masonry blocks 200 arranged in a convex curve are shown. In FIG. 9, the large masonry block legs 210 fully overlap and touch forming a concave wall with a slight convex curvature while in FIG. 10, the large masonry block legs 210 are set slightly apart forming a concave wall with a convex curvature that has a larger radius than that of the concave wall of FIG. 9.

Figure 11:
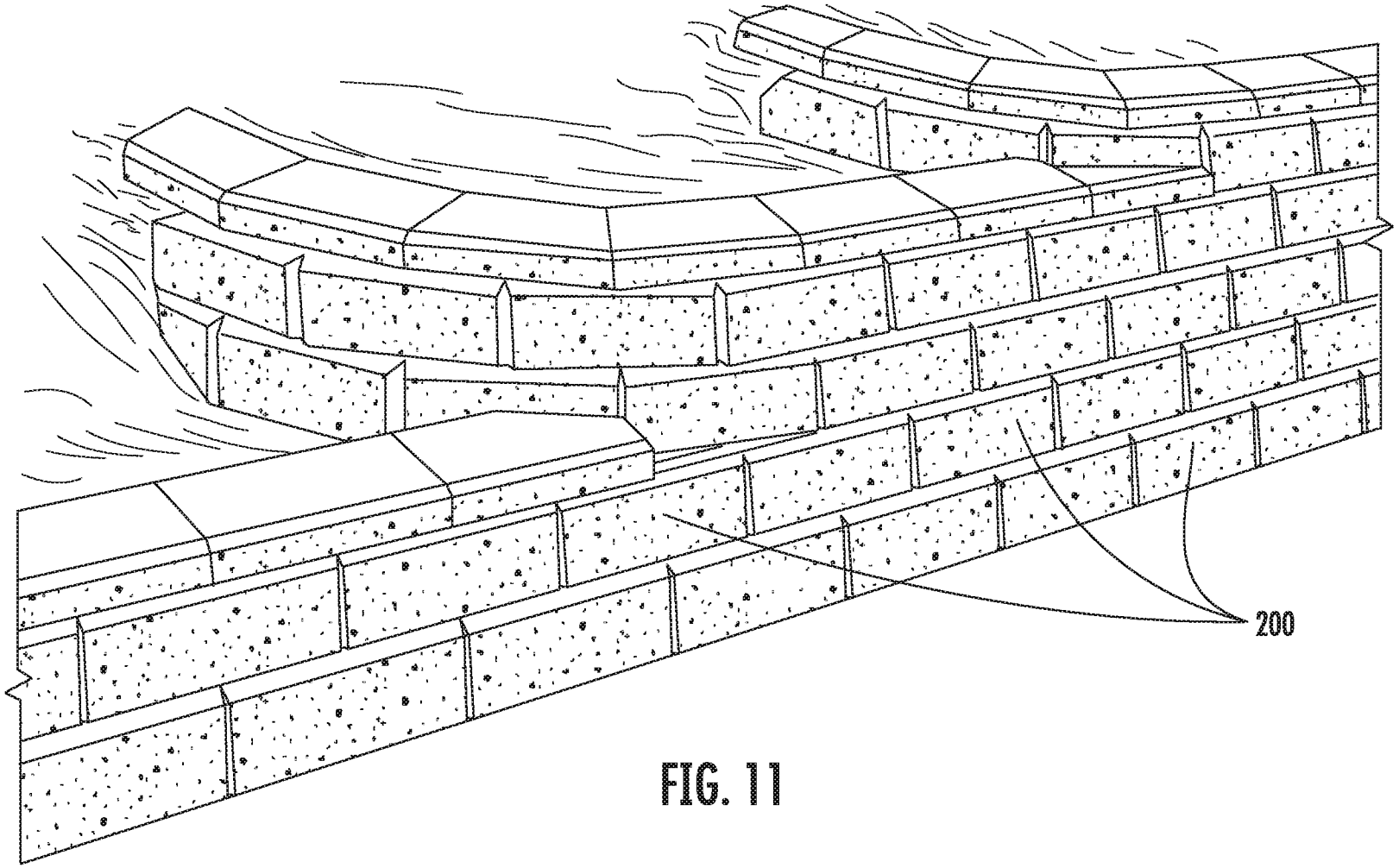
FIG. 11 illustrates a perspective view of a wall having multiple radii formed with the large masonry blocks.

Referring to FIG. 11, a perspective view of a wall having multiple radii formed with the large masonry blocks 200 is shown. Note that, for aesthetic reasons, planar caps are affixed to the upper-most layer of the large masonry blocks 200, as known in the business.

Figure 12:
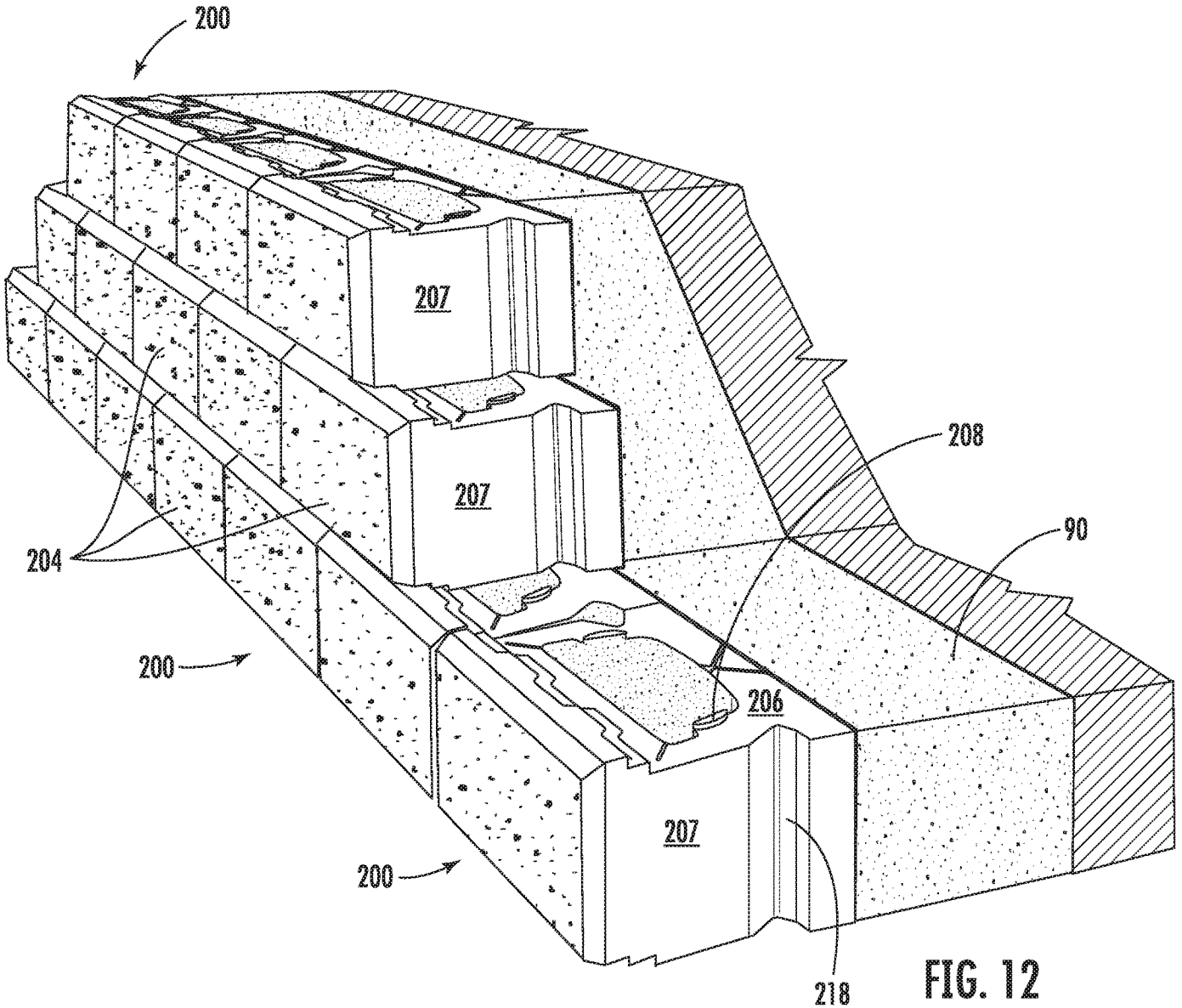
FIG. 12 illustrates a perspective cut-away view of a linear wall made of the large masonry blocks.

Referring to FIG. 12, a perspective cut-away view of a linear wall made of the large masonry blocks 200 is shown. In this, the set back of subsequently higher layers of the large masonry blocks 200 is shown as the large masonry block steps 212/214/212A/214A of a lower layer of the large masonry blocks 200 mate with large masonry block notches 222/224 of a next-higher layer of the large masonry blocks 200. Although note shown in FIG. 12, it is fully anticipated to include a layer of geogrid between subsequent layer of the masonry blocks 100/200. In such, after each layer of masonry blocks 100/200 are set, an area behind the layer of the masonry blocks 100/200 is filled with dirt/rock 90 and the geogrid is laid across the layer of the masonry blocks 100/200, extending atop the dirt/rock 90, providing greater structural strength.

Note that, as shown in this example, distances between of the large masonry block steps 212/214/212A/214A and the large masonry block front 204 define a setback of subsequently higher layers of large masonry blocks 200. By adjusting the molds in the manufacturing process to vary the distances between of the large masonry block steps 212/214/212A/214A and the large masonry block front 204, different setbacks of subsequently higher layers of large masonry blocks 200 are achieved. The same holds true with the small masonry blocks. By adjusting the molds in the manufacturing process to vary the distances between of the small masonry block steps 112/114/112A/114A and the small masonry block front 104, different setbacks of subsequently higher layers of small masonry blocks 100 are achieved. Likewise, the same holds true for walls made of combinations of small masonry blocks 100 and large masonry blocks 200. It is also anticipated that the masonry block notches 122/124/222/224 be adjusted in the same way during the molding/fabricating process. Therefore, for example using the large masonry blocks 200, the setback is determined by the difference between the depth of the step-setback (e.g. the distances between of the large masonry block steps 212/214/212A/214A and the large masonry block front 204) and the notch-setback (e.g. the distances between of the large masonry block notches 222/224 and the large masonry block front 204). The same holds true for the small masonry block 100. If the step-setback is two inches and the notch-setback is one inch, then each subsequent layer of the masonry blocks 100/200 will be setback one inch from the next lower layer of the masonry blocks 100/200. The masonry blocks 100/200 are typically designed for a three-degree to twelve-degree setback.

Figure 13:
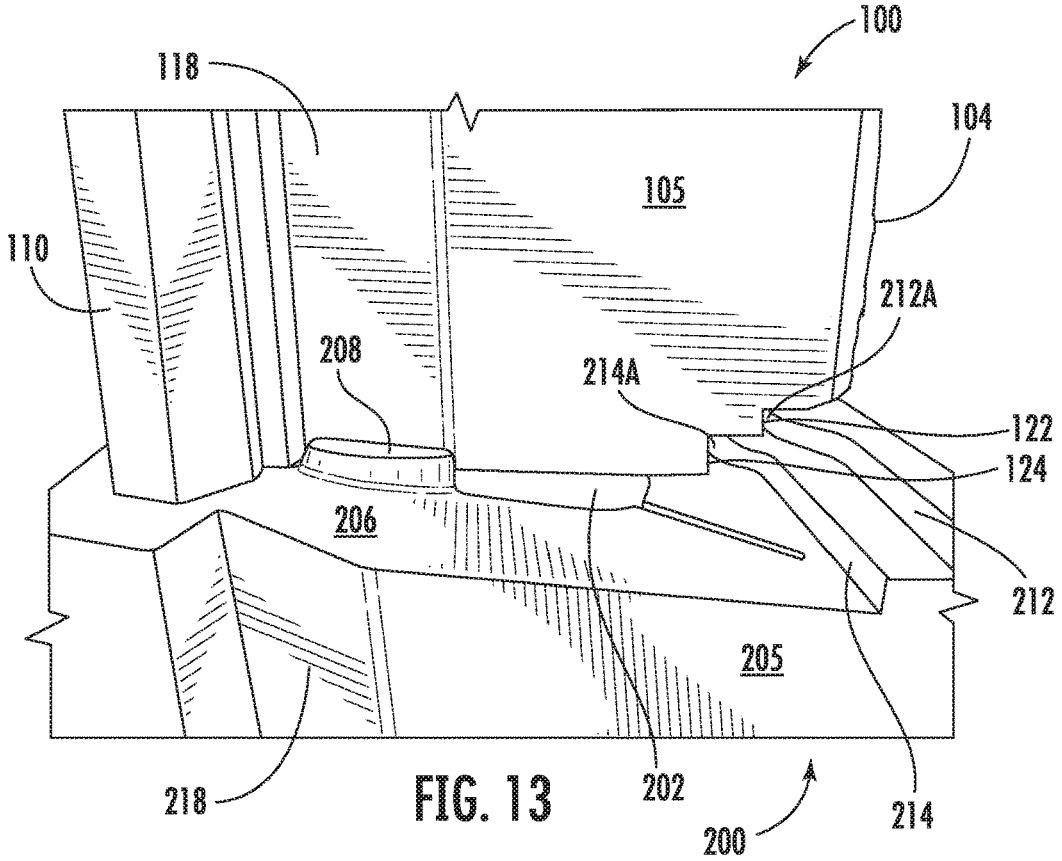
FIG. 13 illustrates a side view of stacking of large masonry blocks.
Figure 14:
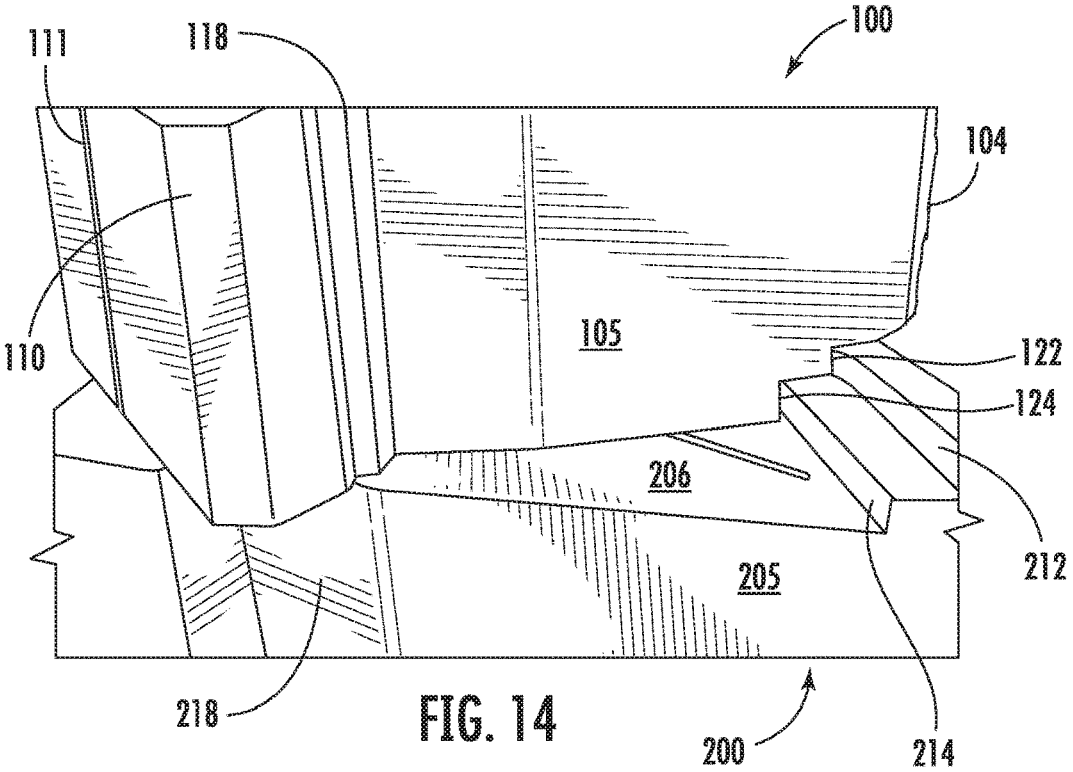
FIG. 14 illustrates a side view of stacking of large masonry blocks in a convex curve.

Referring to FIGS. 13 and 14, side view of stacking of masonry blocks 100/200 are shown. In FIG. 13, the small masonry block 100 is at a minimal angle with respect to the large masonry block 200 and, therefore, the small masonry block notches 122/124 abut against the back-most large block steps 212A/214A (furthest steps from the large masonry block front 204) and the large masonry block key 208 locks into the small masonry block inset 118. In FIG. 14, the small masonry block 100 is at an angle with respect to the large masonry block 200 and, therefore, the small masonry block notches 122/124 abut against outer large masonry block steps 212/214 and the large masonry block key 208 is not visible but located within the small masonry block opening 102. Note that the small masonry block notches 122/124 also abut against the inner large masonry block steps 212A/214A which is not visible in FIG. 14.

Figure 15:
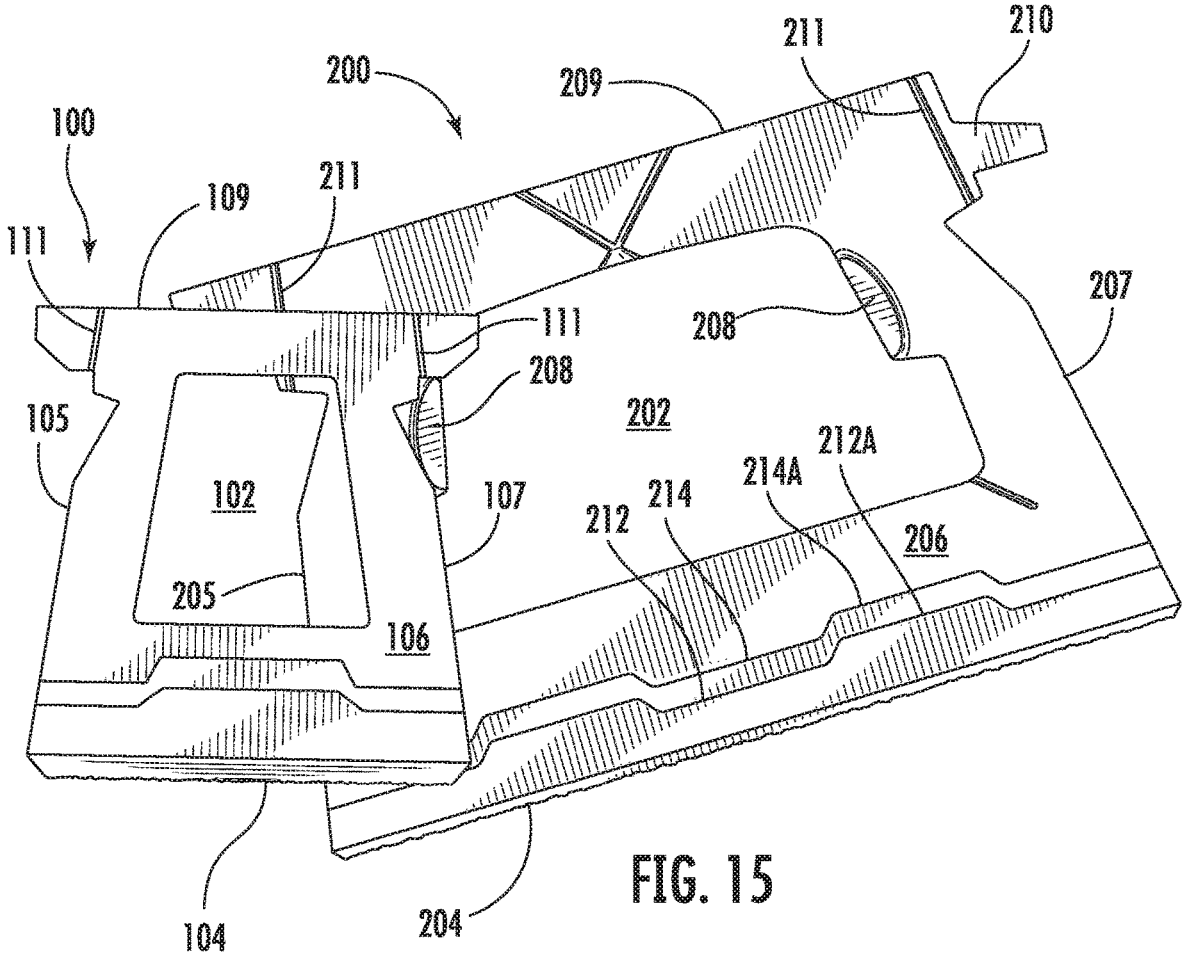
FIG. 15 illustrates a plan view of stacking of a small masonry block atop a large concrete block.
Figure 16:
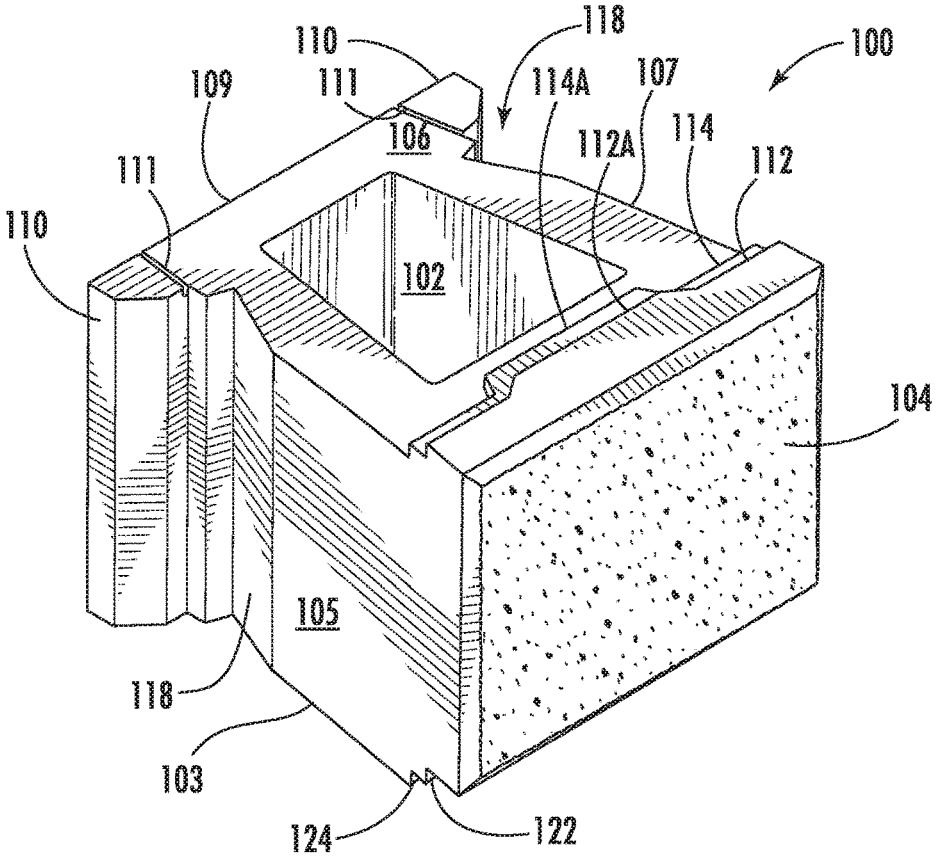
FIG. 16 illustrates a perspective view of a small masonry block.
Figure 17:
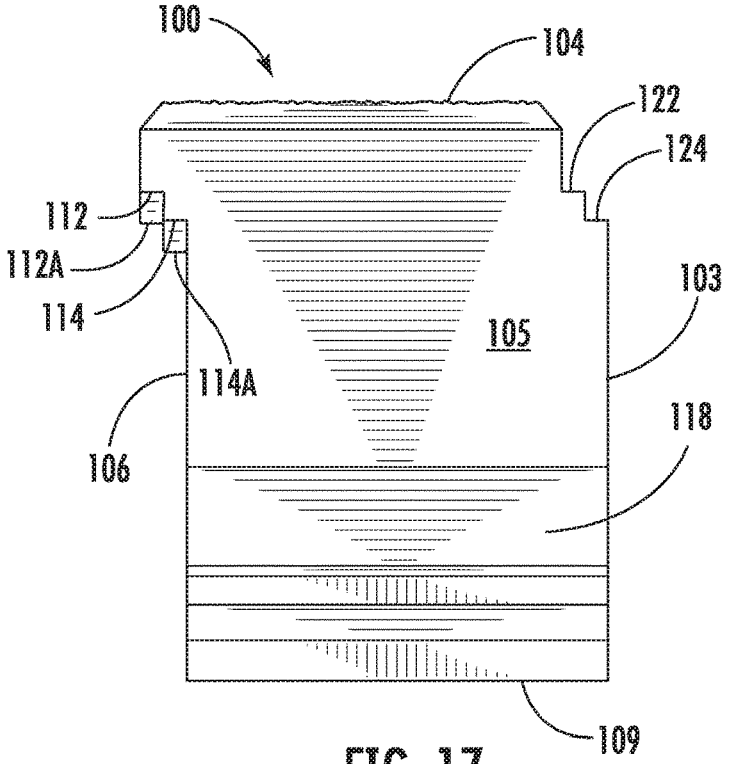
FIG. 17 illustrates a elevational view of the small masonry block.
Figure 18:
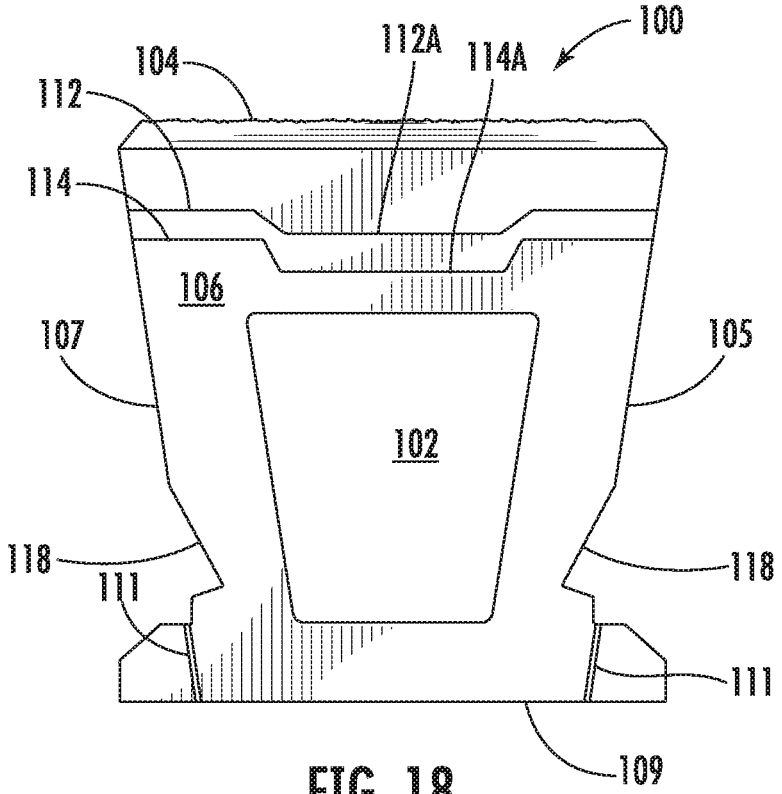
FIG. 18 illustrates a top plan view of the small masonry block.
Figure 19:
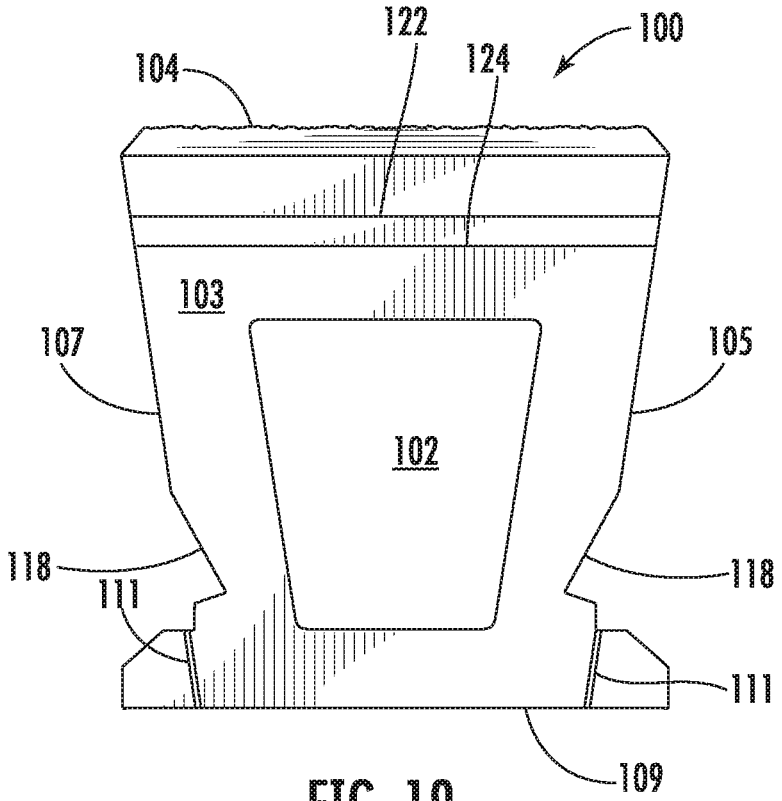
FIG. 19 illustrates a bottom plan view of the small masonry block.
Figure 20:
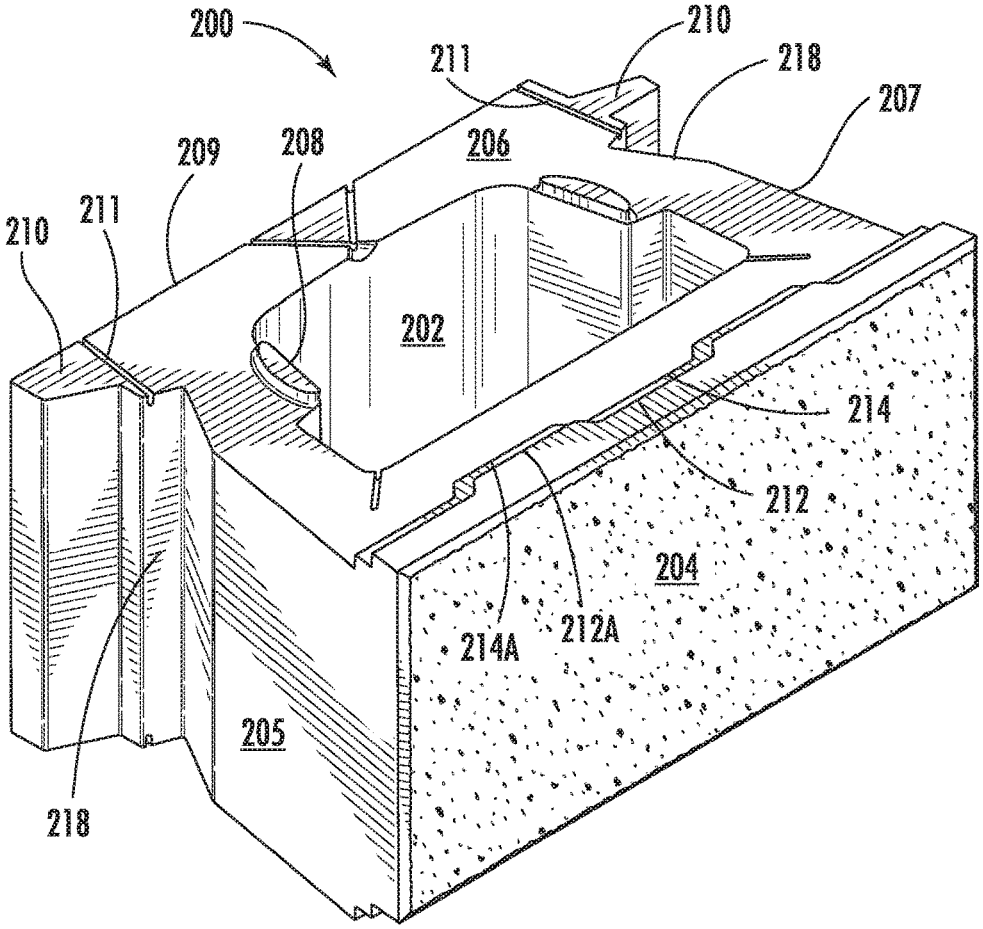
FIG. 20 illustrates a top perspective view of the large masonry block.
Figure 21:
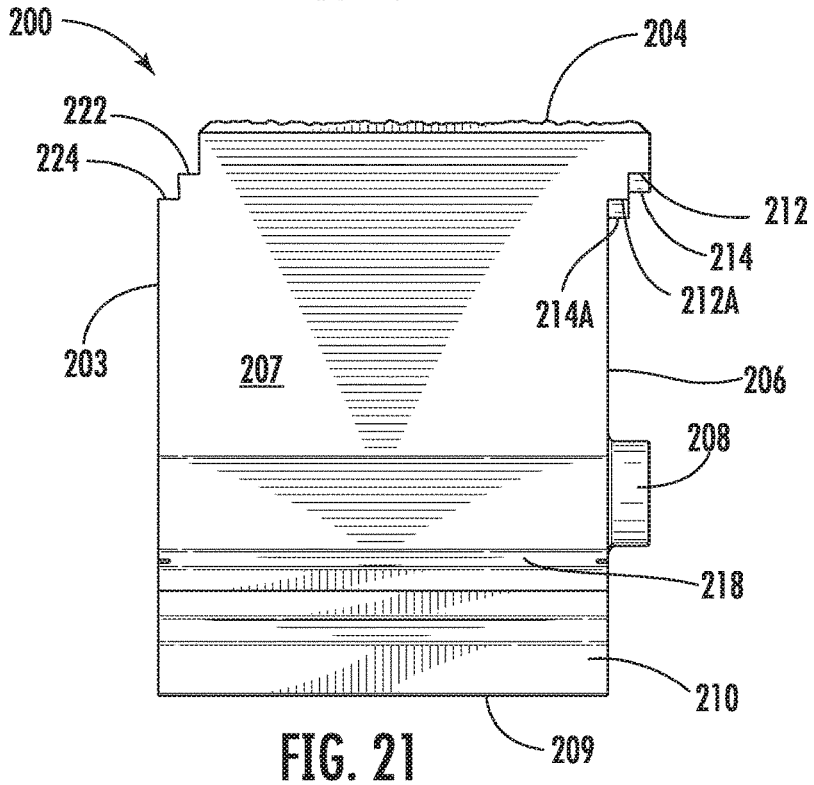
FIG. 21 illustrates a side elevational view of the large masonry block.
Figure 22:
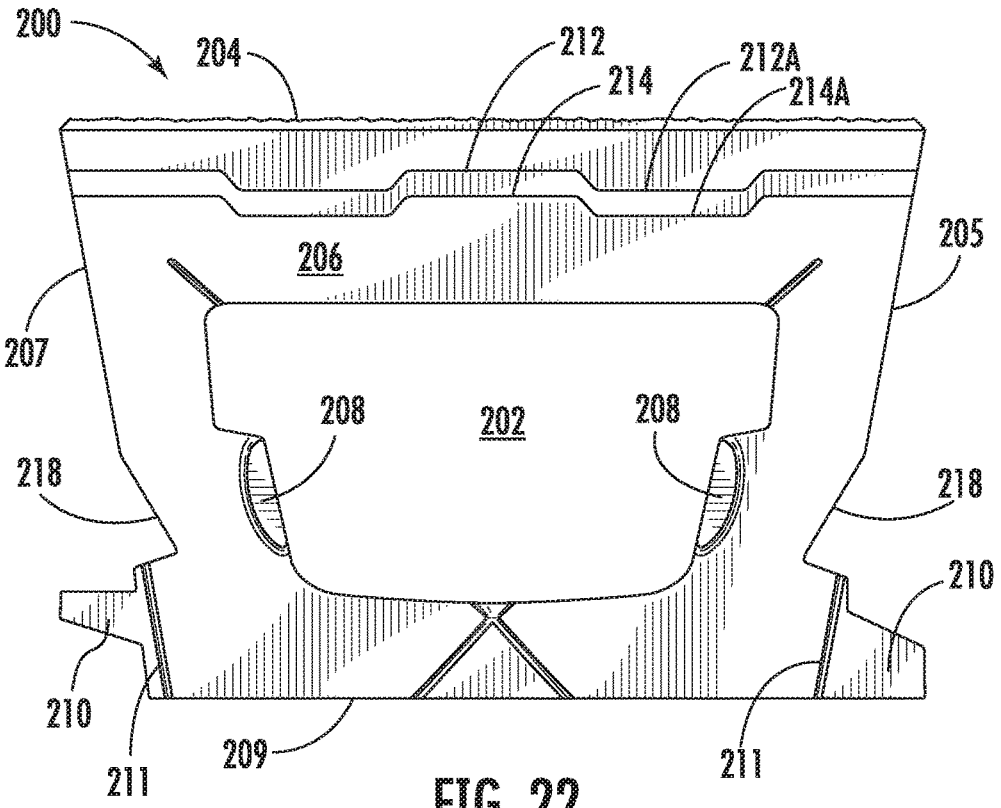
FIG. 22 illustrates a top plan view of the large masonry block.
Figure 23:
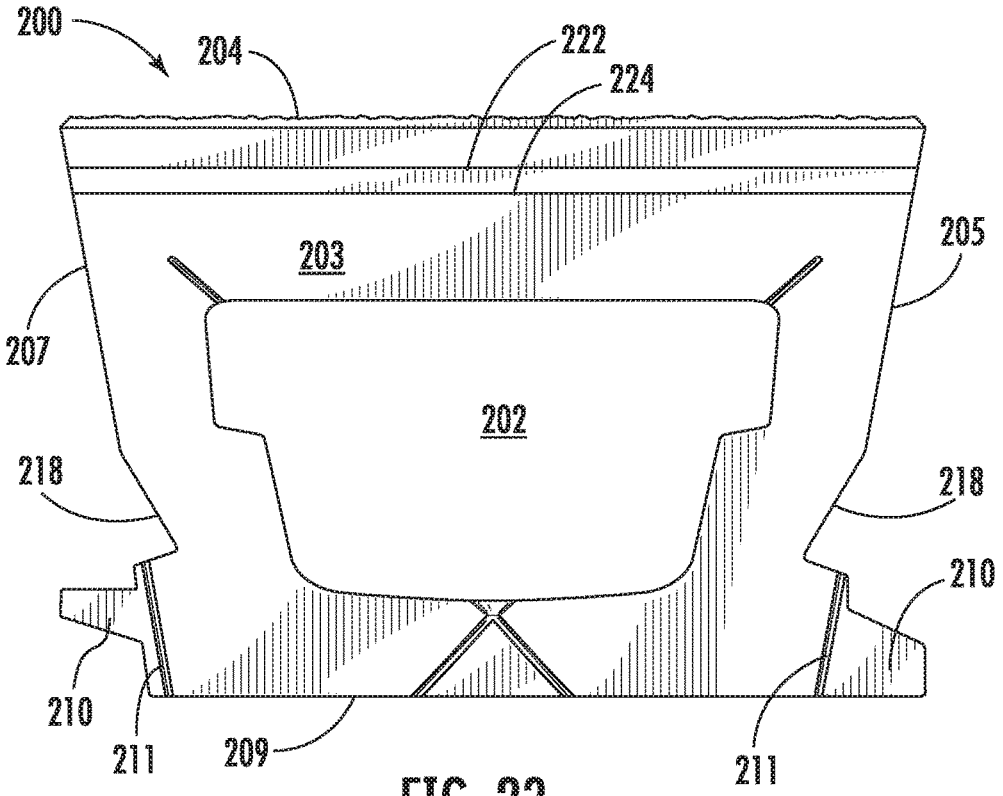
FIG. 23 illustrates a bottom plan view of the large masonry block.

Referring to FIG. 15, a plan view of stacking of a small masonry block 100 atop a large masonry block 200 is shown. The large masonry block key 208 locks into the small masonry block inset 118 and the small masonry block notches 122/124 (not visible) interface with the outer large masonry block steps 212/214.

Referring to FIGS. 16, 17, 18, and 19 views of the small masonry block 100 are shown. The small masonry block 100 has a small masonry block front 104 (the face part that is visible when built into a wall) with small masonry block sides 105/107. Each of the small masonry block sides 105/107 have small masonry block insets 118 and small masonry block legs 110. There is a small masonry block opening 102, the purpose of such is for reducing the total weight of the small masonry block 100.

The small masonry block top surface 106 has small masonry block steps 112/114/112A/114A and the small masonry block bottom surface 103 has small masonry block notches 122/124.

As another masonry block 100/200 is stacked over a small masonry block 100, the small masonry block steps 112/114/112A/114A of the small masonry block 100 mate with the notches (small masonry block notches 122/124 or large masonry block notches 222/224) of the other masonry block 100/200. Likewise, as the small masonry block 100 is stacked upon another masonry block 100/200, the small masonry block notches 122/124 of that small masonry block 100 mates with the steps (small masonry block steps 112/114/112A/114A or large masonry block steps 212/214/212A/214A) if the other masonry block 100/200. This mating helps make sure that the proper setback is made (note the forced setback shown in FIG. 1) and also provides structural support keeping upper layers of the masonry blocks 100/200 from being pushed out with respect to lower layers of the masonry blocks 100/200.

The small block back surface 109 interfaces with whatever material is filled behind the constructed wall. Note that in some installations, after each layer of the masonry blocks 100/200 are stacked, the small masonry block opening 102 is filled with material such as rock, stone, pebbles, dirt, and sand.

In some embodiments, the small masonry block legs 110 have score lines 111 for knocking off the small masonry block legs 110 in a predictable way with a simple tool such as a hammer and chisel.

Referring to FIGS. 20, 21, 22, and 23, views of the large masonry block 200 are shown. The large masonry block 200 has a large masonry block front 204 (the face part that is visible when built into a wall) with large masonry block sides 205/207, Each of the large masonry block sides 205/207 have large masonry block insets 218 and large masonry block legs 210. There is a large masonry block opening 202, the purpose of such is for reducing the total weight of the large masonry block 200.

Each large masonry block 200 has two large masonry block keys 208 on the large masonry block top surface 206. The large masonry block keys 208 provide reference points during installation. As the masonry blocks 100/200 are stacked to create walls, the large masonry block keys 208 provide such reference points to produce walls that are regular and symmetrical. In some installations, the large masonry block keys 208 rest against the side of the masonry block 100/200 that is placed on top of the large masonry block 200, thereby providing extra resistance from movement of the masonry blocks 100/200 with respect to each other. Further, in installations in which a geogrid is placed between successive layers of the masonry blocks 100/200, the large masonry block keys 208 prevent the geogrid sheets from sliding out during construction and during the life of the resulting wall.

The large masonry block keys 208 have another function. As the large masonry block steps 212/214/212A/214A are not level with the large masonry block top surface 206 of the large masonry block 200, the large masonry block keys 208 helps keep stacks of large masonry blocks 200 somewhat level for storage and shipment.

As another masonry block 100/200 is stacked over a large masonry block 200, the large masonry block steps 212/214/212A/214A of the large masonry block 200 mate with the notches (small masonry block notches 122/124 or large masonry block notches 222/224) of the other masonry block 100/200. Likewise, as the large masonry block 200 is stacked upon another masonry block 100/200, the large masonry block notches 222/224 of that large masonry block mates with the steps (small masonry block steps 112/114/112A/114A or large masonry block steps 212/214/212A/214A) if the other masonry block 100/200. This mating helps make sure that the proper setback is made (note the forced setback shown in FIG. 1) and also provides structural support keeping upper layers of the masonry blocks 100/200 from being pushed out with respect to lower layers of the masonry blocks 100/200.

The large block back surface 209 interfaces with whatever material is filled behind the constructed wall. Note that in some installations, after each layer of the masonry blocks 100/200 are stacked, the masonry block openings 102/202 is/are filled with material such as rock, stone, pebbles, dirt, and sand.

In some embodiments, the large masonry block legs 210 have score lines 211 for knocking off the large masonry block legs 210 in a predictable way with a simple tool such as a hammer and chisel.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A masonry block comprising:

a masonry block body having a front, a back, a top surface, a bottom surface, a first side and a second side, the front having a front-top edge and a front-bottom edge, the masonry block having an opening formed between the top surface and the bottom surface;

at least two steps on the top surface rising above the top surface and formed between the opening and the front-top edge, the steps being setback from the front-top edge by a first setback distance;

an equal number of notches in the bottom surface, a first notch of the notches being setback from the front-bottom edge by a second setback distance;

whereas when stacked to form a wall, the steps of a lower masonry block interface with the notches of a next higher masonry block; and whereas the first setback distance is greater than the second setback distance and an overall setback is defined by a difference between the first setback distance minus the second setback distance.

2. The masonry block of claim 1, further comprising at least one masonry block key.

3. The masonry block of claim 2, whereas each of the at least one masonry block keys has a key height that is equal to a height of a highest step of the at least two steps.

4. The masonry block of claim 2, wherein the at least one masonry block key is a first masonry block key and a second masonry block key, the first masonry block key is next to the opening and between the opening and the first side and the second masonry block key is next to the opening and between the opening and the second side.

5. The masonry block of claim 1, wherein the first side and the back define a first leg and the second side and the back define a second leg.

6. The masonry block of claim 5, further comprising a first score line in the first leg and a second score line in the second leg.

7. The masonry block of claim 1, wherein each of the at least two steps on the top surface comprises inner steps and outer steps.

8. The masonry block of claim 1, wherein each of the at least two steps is non-linear for permitting subsequent layers of the masonry blocks to be set at an angle with respect to the masonry block.

9. A method of constructing a structure with masonry blocks such that the structure has a fixed setback, the method comprising:

setting a first layer of the masonry blocks on a footing, the masonry blocks having a front, a back, a top surface, a bottom surface, a first side and a second side, the front having a front-top edge and a front-bottom edge, the masonry block having an opening formed between the top surface and the bottom surface;

setting a subsequent layer of the masonry blocks on top of the first layer of the masonry blocks such that notches in the front bottom edge of each masonry block of the subsequent layer mates with at least two steps on the top surface of the first layer of the masonry blocks, the at least two steps formed on the top surface of the masonry block between the opening and the front-top edge; and whereas the steps being setback from the front-top edge by a first setback distance and a first notch of the notches being setback from the front-bottom edge by a second setback distance and therefore, the fixed setback is defined by subtracting the first setback distance minus the second setback distance.

10. The method of claim 9, further comprising after setting the first layer of the masonry blocks on the footing, backfilling behind the first layer of the first masonry block with a backfill material and laying a geogrid over the first layer of the masonry blocks and over the backfill material before setting the subsequent layer of the masonry blocks on top of the first layer of the masonry blocks.

11. The method of claim 10, wherein the step of backfilling further comprises filling the opening with the backfill material.

12. The method of claim 9, wherein the structure is a retaining wall.

13. A masonry block comprising:

a masonry block body having a front, a back, a top surface, a bottom surface, a first side and a second side, the front having a front-top edge and a front-bottom edge, the masonry block having an opening formed between the top surface and the bottom surface;

two steps on the top surface of the masonry block rising above the top surface between the opening and the front-top edge, a first step of the two steps being setback from the front-top edge by a first setback distance;

two notches in the bottom surface of the masonry block, a first notch of the two notches being setback from the front-bottom edge by a second setback distance;

whereas when stacked to form a wall, the two steps of a lower masonry block interface with the two notches of a next higher masonry block; and whereas the first setback distance is greater than the second setback distance and an overall setback of the wall is defined by a difference between the first setback distance minus the second setback distance.

14. The masonry block of claim 13, further comprising at least two masonry block keys.

15. The masonry block of claim 14, whereas each of the at least two masonry block keys has a key height that is equal to a height of a highest step of the two steps.

16. The masonry block of claim 13, wherein a first masonry block key of the at least two masonry block keys is next to the opening and between the opening and the first side and a second masonry block key of the at least two masonry block keys is next to the opening and between the opening and the second side.

17. The masonry block of claim 13, wherein the first side and the back define a first leg and the second side and the back define a second leg.

18. The masonry block of claim 17, further comprising a first score line in the first leg and a second score line in the second leg.

19. The masonry block of claim 13, wherein each of the steps on the top surface comprises inner steps and outer steps.

20. The masonry block of claim 13, wherein each of the two steps is non-linear for permitting subsequent layers of the masonry blocks to be set at an angle with respect to the masonry block.

* * * * *